US006819881B2

(12) United States Patent
Kurita et al.

(10) Patent No.: US 6,819,881 B2
(45) Date of Patent: Nov. 16, 2004

(54) IMAGE FORMING APPARATUS WITH DEVELOPING UNITS FOR CONTROLLING FIXING CONDITIONS OF TONER

(75) Inventors: Atsumi Kurita, Ebina (JP); Kunio Yamada, Ebina (JP); Makoto Hirota, Ebina (JP); Takashi Yamamuro, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/359,122

(22) Filed: Feb. 6, 2003

(65) Prior Publication Data

US 2004/0037578 A1 Feb. 26, 2004

(30) Foreign Application Priority Data

Aug. 20, 2002 (JP) ..... 2002-239850

(51) Int. Cl.[7] ..... G03G 15/08; G03G 15/20
(52) U.S. Cl. ..... 399/12; 399/67; 399/69
(58) Field of Search ..... 399/12, 67, 69

(56) References Cited

U.S. PATENT DOCUMENTS 4,937,626 A * 6/1990 Kohtani et al. ..... 399/12
5,001,519 A * 3/1991 Saito ..... 399/69
5,063,410 A * 11/1991 Kinoshita et al. ..... 399/12

FOREIGN PATENT DOCUMENTS

JP A 2000-131875 5/2000
JP A 2001-194846 7/2001

* cited by examiner

*Primary Examiner*—William J. Royer
(74) *Attorney, Agent, or Firm*—Oliff & Berridge, PLC

(57) ABSTRACT

To provide an image forming apparatus capable of forming an image with a normal toner and forming an image with special toner, which makes it possible to perform appropriate fixing of a toner to be used according to characteristics of the toner. There is provided an image forming apparatus including: an image bearing member; a first developing unit for forming an image consisting an image consisting of one type or plural types of first developer on the image bearing member; a second developing unit for forming an image consisting of one type or plural types of second developer different from the first developer on the image bearing member; a transfer section for transferring the image formed on the image bearing member to a recording medium; a fixing apparatus for fixing the image on the recording medium under predetermined fixing conditions and conveying the same; a developing unit judging section for judging a type of a developing unit used by the image forming apparatus; and a control unit for controlling the fixing conditions based on a judgment result of the developing unit judging section.

28 Claims, 10 Drawing Sheets

(a)

(b)

IMAGE FORMING APPARATUS WITH DEVELOPING UNITS FOR CONTROLLING FIXING CONDITIONS OF TONER

BACKGROUND OF THE INVENTION

1. Field of Invention

The present invention relates to an image forming apparatus using an electrophotographic system, such as a copying machine, a printer, a facsimile, or a combination machine of the above machines, and more specifically to an image forming apparatus in which a special toner image can be obtained in addition to a normal toner image.

2. Description of Related Art

Conventionally, an image forming apparatus such as a copying machine or a printer that utilizes the electrophotographic system or the electrostatic transfer system is widely known. In such an image forming apparatus, a black-and-white image, a full-color image formed with toners of yellow, cyan, and magenta, and the like are usually formed on a paper and outputted. In addition, unlike the technique for obtaining these (flat) images, there has been proposed a technique for obtaining a three-dimensional image using a special toner (foaming toner). For example, the applicant has already proposed "Image forming toner, preparation method thereof, three-dimensional image forming method and image forming apparatus" and "Image forming apparatus" in JP 2000-131875 A and JP 2001-194846 A, respectively.

Incidentally, the special toner has preferable fixing conditions that are different from those of the normal toner in terms of characteristics. For example, in order to form a satisfactory three-dimensional image, in general, it is necessary to give a foamable toner a heat quantity larger than that for the normal toner.

SUMMARY OF THE INVENTION

The present invention has been made in view of the above circumstances and provides an image forming apparatus capable of forming an image with the normal toner and forming an image with the special toner, which makes it possible to perform appropriate fixing of a toner to be used according to characteristics of the toner.

According to the present invention, there is provided an image forming apparatus including: an image bearing member; a first developing unit for forming an image consisting of one type or plural types of first developer on the image bearing member; a second developing unit for forming an image consisting of one type or plural types of second developer different from the first developer on the image bearing member; a transfer section for transferring the image formed on the image bearing member to a recording medium; a fixing apparatus for fixing the image on the recording medium under predetermined fixing conditions and conveying the same; a developing unit judging section for judging a type of a developing unit used by the image forming apparatus; and a control unit for controlling the fixing conditions based on a judgment result of the developing unit judging section.

Further, according to the present invention, there is provided an image forming apparatus including: an image bearing member; a first developing unit for forming an image consisting of one type or plural types of first developer on the image bearing member, a transfer section for transferring the image formed on the image bearing member to a recording medium; a fixing apparatus for fixing the image on the recording medium under predetermined fixing conditions and conveying the same, the image forming apparatus is capable of having mounted thereto a second developing unit for forming an image consisting of one type or plural types of second developer different from the first developer on the image bearing member; a developing unit judging section for judging a type of a developing unit used by the image forming apparatus; and a control unit for controlling the fixing conditions based on a judgment result of the developing unit judging section.

As described above, the image forming apparatus may be provided with both the first developing unit and the second developing unit from an initial state of development or may be provided with only the first developing unit in the initial state and mounted with the second developing unit later (additionally or alternatively).

Further, the image forming apparatus may comprise a user interface section in which an instruction from a user is inputted, wherein the developing unit judging section judges a type of a developing unit used by the image forming apparatus based on an instruction from the user interface section. Alternatively, the image forming may further comprise an image processing section in which an image forming command is inputted, wherein the developing unit judging section judges a type of a developing unit used by the image forming apparatus based on a result of analysis of the image forming instruction by the image processing section.

The control unit can control the fixing conditions such that first fixing conditions in using only the first developing unit and second fixing conditions in using only the second developing unit are different from each other. In addition, in the case where both the first developing unit and the second developing unit are used, the control unit can control the fixing conditions such that intermediate fixing conditions between the first fixing conditions and the second fixing conditions are realized. Moreover, the control unit can also determine the intermediate fixing conditions according to a frequency of using the first developing unit and the second developing unit. That is, the control unit can determine the intermediate fixing conditions such that the intermediate fixing conditions become closer to the first fixing conditions in the case where the first developing unit is used more frequently or closer to the second fixing conditions in the case where the second developing unit is used more frequently.

In addition, the first developer and the second developer can be distinguished from each other in that the first developer does not contain a foaming agent and the second developer contains a foaming agent, the first developer contains a colorant of a nonmetallic color and the second developer contains a colorant of a metallic color, the first developer contains a colorant of a chromatic color and the second developer contains a colorant of an achromatic color, or the first developer contains a specific colorant and the second developer contains a colorant different from the specific colorant.

Examples of the first developer include a developer (of one type) containing a colorant of black, developers of three types containing colorants of yellow, magenta, and cyan, respectively, and developers of four types containing a colorant of black in addition to these developers of three types. In addition, as examples of the second developer, there are a colorless developer (of one type) containing a foaming agent and not containing a colorant, a developer (of one type) containing a foaming agent and a colorant, a developer (of one type) not containing a foaming agent and containing a colorant of a metallic color, and developers of plural types that are arbitrary combinations of the above-mentioned developers. Note that the foaming agent and the colorant may be internally added or externally added to a developer.

Here, when the first developer does not contain a foaming agent and the second developer contains a foaming agent, fixing conditions can be controlled as described below.

First, the fixing section is provided with a pair of fixing rotators that come into press-contact with each other and rotate at a predetermining fixing rate, and a second fixing rate that is the second fixing condition is controlled to be lower than a first fixing rate that is the first fixing condition.

Second, the fixing section is provided with a pair of fixing rotators that come into press-contact with each other and rotate and a heating source that heats at least one of the pair of fixing rotators to a predetermined fixing temperature, and a second fixing temperature that is the second fixing condition is controlled to be higher than a first fixing temperature that is the first fixing condition.

In relation to the image forming apparatus described above, the fixing section is provided with a pair of toner side and non-toner side fixing rotators that come into press-contact with each other and rotate and a heating source that heats the non-toner side fixing rotator to a predetermined fixing temperature, and a second fixing temperature that is the second fixing condition is controlled to be higher than a first fixing temperature that is the first fixing condition.

Third, the fixing section is provided with a pair of fixing rotators that come into press-contact with each other and rotate, a heating source that heats one of the pair of fixing rotators, and a latch section that brings the pair of fixing rotators into press-contact with each other from a separated state at predetermined latch timing, and second latch timing that is the second fixing condition is controlled to be earlier than first latch timing that is the first fixing condition.

Fourth, the fixing section is provided with a pair of fixing rotators that come into press-contact with each other and rotate and a peeling member that is provided in a predetermined position on a downstream side of the press-contact portion and peels a recording medium adhering to the fixing rotators, and a second position that is the second fixing condition is controlled to be apart from the press-contact portion by a larger distance than a first position that is the first fixing condition.

Fifth, the fixing section is provided with a pair of fixing rotators that come into press-contact with each other and rotate and a conveyor member that conveys a recording medium after passing through the press-contact portion at a predetermined conveying speed, and a second conveying speed after fixing that is the second fixing condition is controlled to be lower than a first conveying speed after fixing that is the first fixing condition.

Note that the fixing rotator may have a roll shape or an endless belt shape. In addition, the pair of fixing rotators may be a pair of rolls, a pair of endless belts, or a combination of a roll and an endless belt.

In addition, the second developing unit may be mountable in place of the entirety or a part of the first developing unit (alternatively) or may be mountable in addition to the first developing unit (additionally). Further, the developing unit may be mounted on an image forming apparatus one by one or may be mounted on the image forming apparatus in a plural form collectively. Moreover, the developing unit may be mounted on the image forming apparatus independently or may be mounted on the image forming apparatus as an image forming unit including an image bearing member in addition to the developing unit.

In addition, in order to judge a type of a mounted developing unit, the developing unit may have a special shape corresponding to a developer therefor and have a developing unit judging section for judging a type of a mounted developing unit based on the special shape. Alternatively, the developing unit may have a developing unit judging section that is provided with a nonvolatile memory and, at the same time, stores developer information indicating a developer therefor in the nonvolatile memory and judges a type of a mounted developing unit based on the developer information read from the nonvolatile memory. Moreover, in the case where the developing unit is mounted on the image forming apparatus as an image forming unit including an image bearing member in addition to the developing unit, the image forming unit may have a special shape corresponding to a developer therefor or may be provided with a nonvolatile memory.

In addition, the transfer unit may include only a final transfer section and transfer an image on the image bearing member to a recording medium directly. Alternatively, the transfer unit may be provided with an intermediate transfer member and an intermediate transfer section in addition to the final transfer section, transfer an image on the image bearing member to the intermediate transfer member once by the intermediate transfer section, and further transfer the image on the intermediate transfer member to a recording medium by the final transfer section.

Further, the present invention can be applied to any image forming apparatus of the electrophotographic system. Turning to a relationship between a developing unit and an image bearing member (photosensitive member, latent image bearing member), there are an image forming apparatus in which each developing unit and image bearing member has a one to one relationship and an image forming apparatus in which each developing unit and image bearing member has an N (N is a natural number) to one relationship. As examples of the former image forming apparatus, there are a monochrome image forming apparatus, a full-color image forming apparatus of the tandem system using an intermediate transfer member, from an upstream side to a downstream side of which image forming units corresponding to each color are arranged, and the like. As examples of the latter image forming apparatus, there are image forming apparatus using a developing apparatus of the rotary system, a full-color image forming apparatus in which developing units corresponding to each color are arranged from an upstream side to a downstream side of an image bearing member, and the like.

According to the present invention, there is provided an image forming apparatus capable of forming an image with a normal toner and forming an image with a special toner, which makes it possible to perform appropriate fixing according to characteristics of a toner to be used.

BRIEF DESCRIPTION OF THE DRAWINGS

Preferred embodiments of the present invention will be described in detail based on the following figures, wherein:

FIGS. 8A1 to 8A4, 8B1 to 8B4, and 8C illustrate steps and states of stacking toner images on a photosensitive drum, an intermediate transfer belt, and a recording paper;

DETAILED DESCRIPTION OF PREFERRED EMBODIMENTS

Embodiment Modes of the present invention will be hereinafter described with reference to the accompanying drawings.

Embodiment Mode 1

Figure 1:
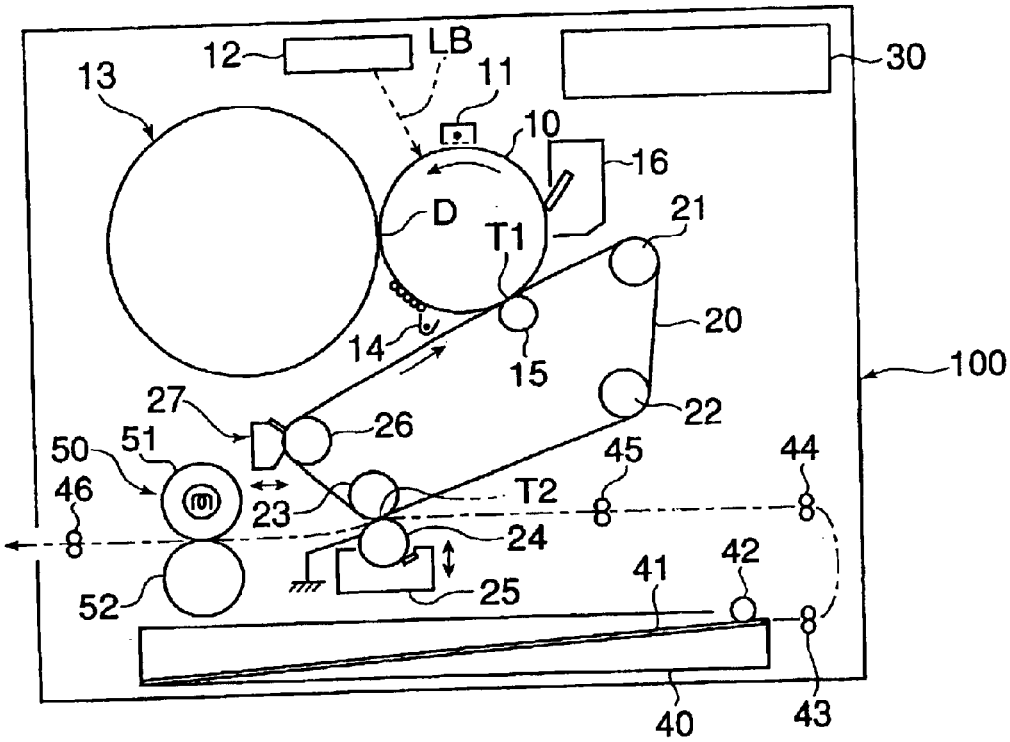
FIG. 1 is a schematic sectional view illustrating an example of a color printer according to Embodiment Modes 1 to 3 of the present invention.

FIG. 1 shows a color printer 100 of the electrophotographic system as an image forming apparatus according to Embodiment Mode 1 of the present invention. In addition, FIG. 2 shows a color copying machine 102 of the electrophotographic system as the image forming apparatus according to Embodiment Mode 1 of the present invention.

Figure 2:
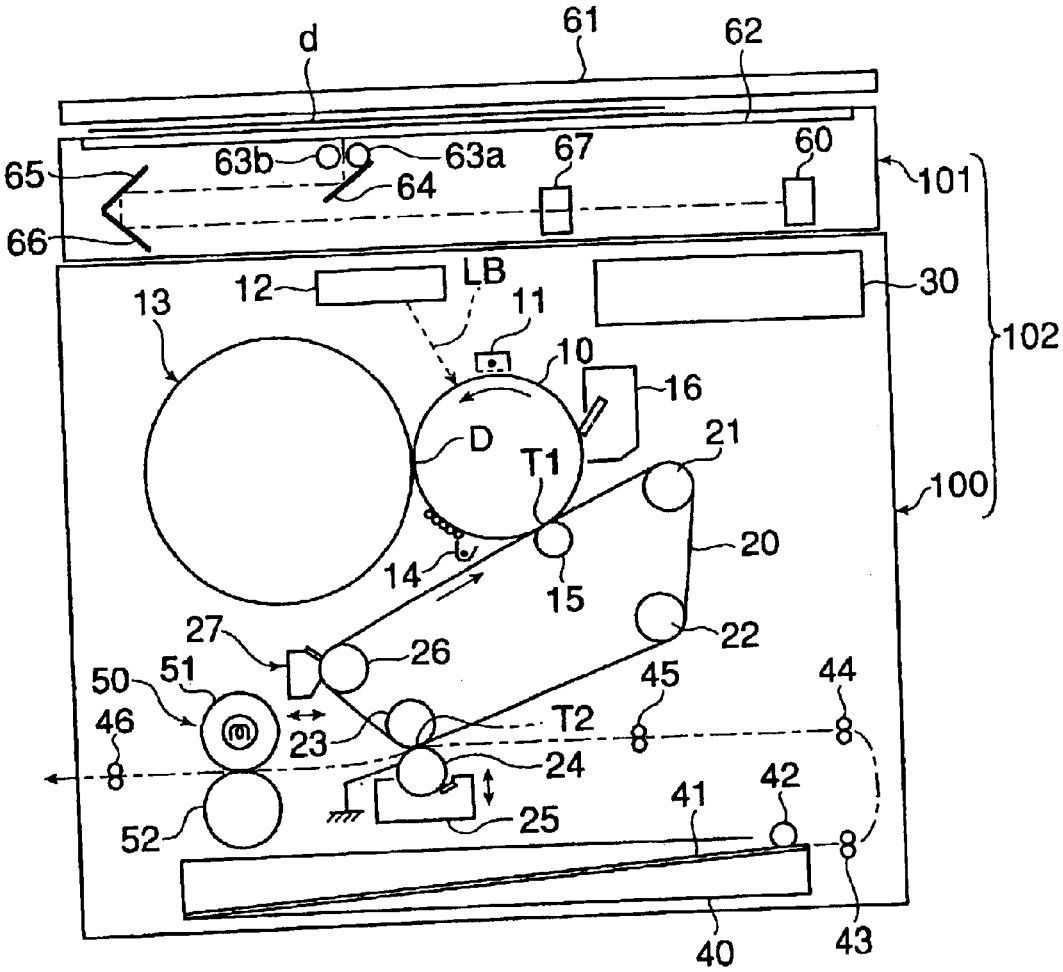
FIG. 2 is a schematic sectional view illustrating an example of a color copying machine according to Embodiment Modes 1 to 3 of the present invention.

In FIGS. 1 and 2, reference numeral 100 denotes a color printer and a main body of a color copying machine. As shown in FIG. 2, an original reader 101 for reading an image of an original d pressed by a platen cover 61 is arranged above this color copying machine 102 main body. This original reader 101 is adapted to illuminate the original d placed on a platen glass 62 with light sources 63*a* and 63*b*, scan and expose a reflected light image from the original d on an image reading element 60 including CCD via a reduction optical system including a full-rate mirror 64, half-rate mirrors 65 and 66, and an imaging lens 67, and read a light image reflected by coloring material of the original d with this image reading element 60 at a predetermined dot density (e.g., 16 dots/mm).

The light image reflected by coloring material of the original d read by the original reader 101 is sent to an image processing device 30 as, for example, reflectance data of an original for three colors of red (R), green (G), and blue (B) (8 bits each). In this image processing device 30, predetermined image processing such as shading correction, positional deviation correction, brightness/color spatial conversion, gamma correction, frame deletion, or color/movement edition is applied to the reflectance ratio data of the original d.

Then, the image data subjected to the predetermined image processing in the image processing device 30 as described above is sent to a raster output scanner (ROS) 12 as gradation data of original coloring material for four colors of yellow (Y), magenta (M), cyan (c), and black (BK) (8 bits each). In this ROS 12, image exposure by laser beams is performed according to the gradation data of original coloring material.

An image forming section capable of forming plural toner images of different colors is disposed inside the color printer 100 and the copying machine main body. This image forming section is constituted mainly of the ROS 12 as an image exposure section, a photosensitive drum 10 as an image bearing member on which an electrostatic latent image is formed, and a developing apparatus 13 of the rotary system as a developing section capable of developing the electrostatic latent image formed on the photosensitive drum 10 to form plural toner images of different colors.

As shown in FIGS. 1 and 2, the ROS 12 modulates a not-shown semiconductor laser according to gradation data of original reproducing coloring material and emits a laser beam LB from this semiconductor laser according to the gradation data. The laser beam LB emitted from this semiconductor laser is deflected and scanned by a not-shown rotary polygon mirror, and scanned and exposed on the photosensitive drum 10 as an image bearing member via a not-shown f.θ lens and reflection mirror.

The photosensitive drum 10 on which the laser beam LB is scanned and exposed by the ROS 12 is adapted to be rotated and driven at a predetermined speed along an arrow direction by a not-shown drive section. The surface of this photosensitive drum 10 is charged to a predetermined polarity (e.g., negative polarity) and potential by a scorotron 11 for primary charging in advance and, then, an electrostatic latent image is formed as the laser beam LB is scanned and exposed according to the gradation data of original reproducing coloring material. For example, the surface of the photosensitive drum 10 is uniformly charged to −650 V and, then, the laser beam LB is scanned and exposed on an image portion thereof, and an electrostatic latent image with −200 V in the exposed part is formed thereon.

The electrostatic latent image formed on the photosensitive drum 10 is subjected to reversal development, for example, with a toner (charged coloring material) charged in the negative polarity, which is the same polarity as the charged polarity of the photosensitive drum 10, in a development area D by the developing apparatus 13 of the rotary system provided with developing devices (first developing units) 13Y to 13BK corresponding to yellow (Y), magenta (M), cyan (C), and black (BK), and turns into a toner image of a predetermined color. In this case, for example, a developing bias voltage of −500 V is applied to developing rolls of the developing devices 13Y to 13BK. Note that the toner image formed on the photosensitive drum 10 is subjected to charging of a negative polarity by a pre-transfer charger 14 if necessary, and an amount of charges of the toner image is adjusted.

A toner image (image) of a toner (first developer) of each color formed on the photosensitive drum 10 is multiply transferred onto an intermediate transfer belt 20 serving as an intermediate transfer member, which is arranged below the photosensitive drum 10, at a first nip portion T1 by a primary transfer roll 15 serving as a first transfer section. This intermediate transfer belt 20 is stretched and suspended by a drive roll 21, a driven roll 26, a tension roll 22, and a backup roll 23 serving as an opposed roll forming a part of a secondary transfer section, and supported rotatably along an arrow direction at a moving speed identical with a peripheral speed of the photosensitive drum 10.

Toner images of all or a part of four colors of yellow (Y), magenta (M), cyan (C), and black (BK) formed on the photosensitive drum 10 are sequentially transferred in a stacked state onto the intermediate transfer belt 20 by the primary transfer roll 15 according to a color of an image to be formed. The toner image transferred onto the intermediate transfer belt 20 is transferred onto a recording paper P, which serves as a recording medium to be conveyed to a secondary transfer position T2 at predetermined timing, by a press-contacting force and an electrostatic attracting force acting between the backup roll 23 supporting the intermediate transfer belt 20 and a secondary transfer roll 24 forming a part of the secondary transfer section that is in press-contact with the backup roll 23.

As shown in FIGS. 1 and 2, the recording paper (recording medium) P of a predetermined size supported by a sheet guide 41 is fed from a sheet feeding cassette 40, which serves as a recording medium containing member arranged in the lower part of the color printer 100 and the copying machine main body, by a pickup roll 42 and feed and retard rolls 43. The fed recording paper P is conveyed to the secondary transfer position T2 of the intermediate transfer belt 20 at predetermined timing by plural conveyor rolls 44 and registration rolls 45. Then, as described above, toner images of predetermined colors are collectively transferred onto the recording paper P from the intermediate transfer belt 20 by the backup roll 23 and the secondary transfer roll 24 serving as the secondary transfer section.

In addition, after being separated from the intermediate transfer belt 20, the recording paper P, to which the toner images of predetermined colors are transferred from the intermediate transfer belt 20, is conveyed to a fixing apparatus 50. Then, the toner images are fixed on the recording paper P with heat and pressure by a heating roll 51 and a pressure roll 52 of the fixing apparatus 50, and discharged to the outside of the color printer 100 and the color copying machine 102 by discharge rolls 46, whereby the process of forming a color image ends.

Note that, in FIGS. 1 and 2, reference numeral 16 denotes a cleaning device for removing a residual toner, paper powder, and the like from the surface of the photosensitive drum 10 after the transfer process ends; 27, a cleaner for intermediate transfer belt for cleaning the intermediate transfer belt 20; and 25, a cleaner for cleaning the secondary transfer roll 24. In addition, the cleaner 27 for the intermediate transfer belt 20 and the cleaner 25 for the secondary transfer roll 24 are constituted so as to come into contact with and separate from the intermediate transfer belt 20 at predetermined timing.

Incidentally, in the color printer 100 and the color copying machine 102 according to Embodiment Mode 1, it is possible to mount a developing device (secondary developing unit) 13E corresponding to a foamable toner E (second developer containing a foaming agent and not containing a colorant) in place of one of the developing devices (first developing units) 13Y to 13BK corresponding to toners (first developers not containing a foaming agent and containing a colorant of a nonmetallic color) of yellow (Y), cyan (C), magenta (M), and black (BK), respectively. Note that, when heated by the fixing apparatus 50, the volume of the foamable toner E discussed later is expanded by the heat and can form a three-dimensional image on the recording paper P.

Figure 3:
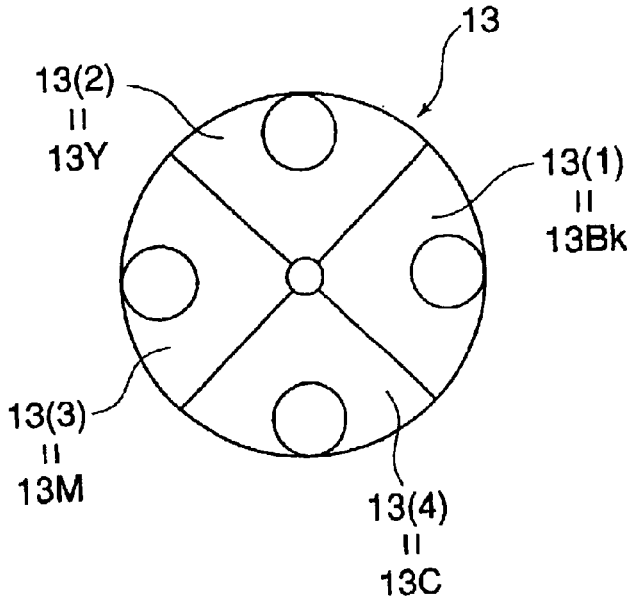
FIGS. 3A and 3B are schematic sectional views illustrating a rotary developing apparatus of the color printer and the color copying machine according to Embodiment Mode 1 of the present invention.
Figure 3:
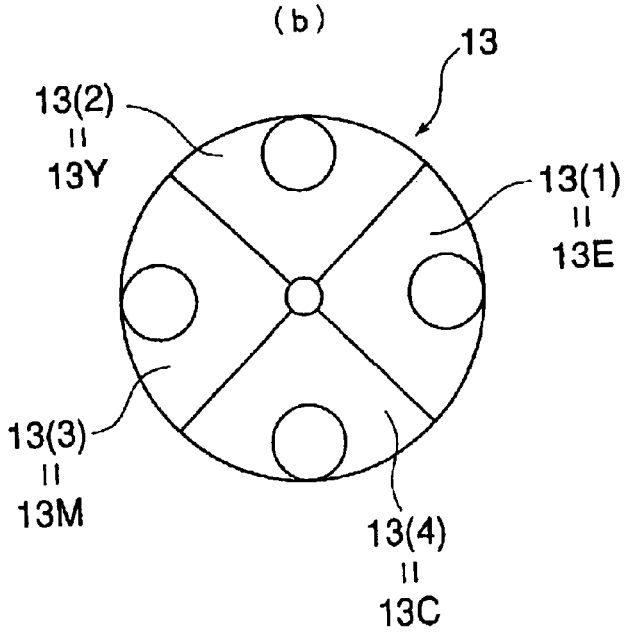
Figure 4:
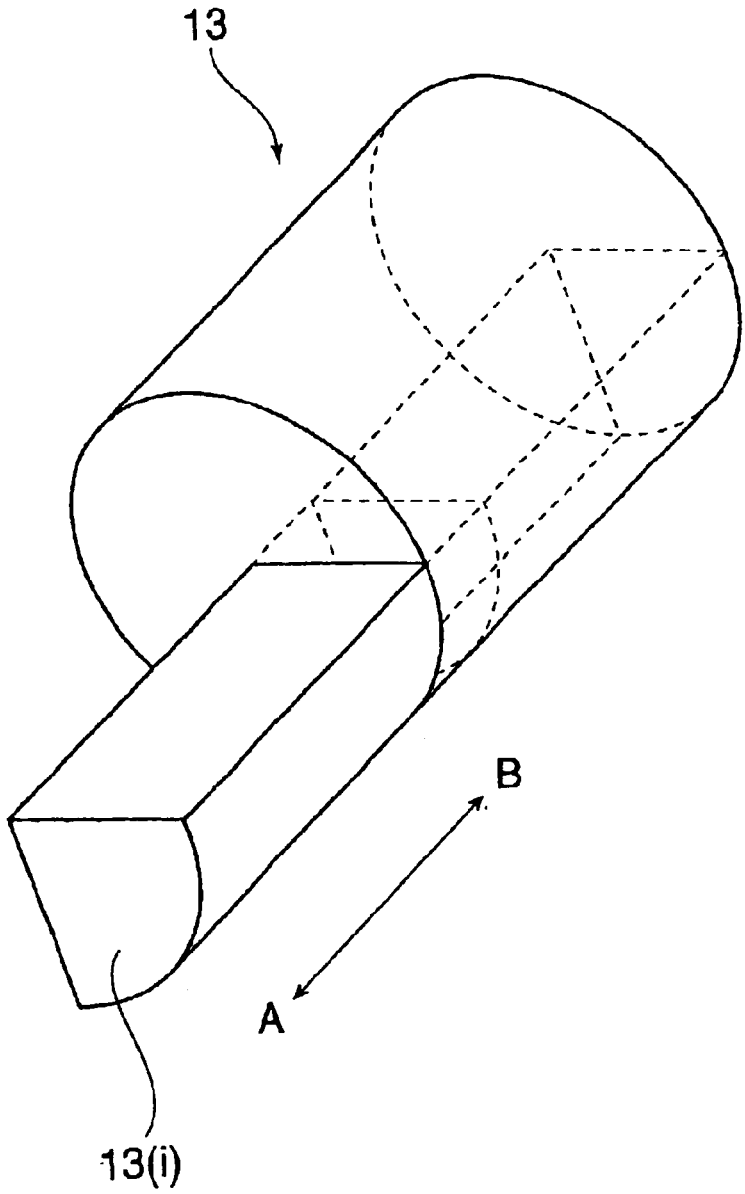
FIG. 4 is a perspective view illustrating how a developing device is removed from the rotary developing apparatus of FIGS. 3A and 3B.

As shown in FIGS. 3A and 3B, the developing apparatus 13 of the rotary system is provided with first to fourth developing devices 13[13(1) to 13(4)] different from each other for each of its four areas divided equally in a fan shape around its rotation axis. In addition, as shown in FIG. 4, each of the developing devices 13(1) to 13(4) slides along a guide rail provided in each of the developing devices 13(1) to 13(4), which is parallel with the rotation axis, and a guide rail support provided in the developing apparatus main body to be opposed to the guide rail by applying a force in a direction B and a direction A in FIG. 4, and is constituted detachably.

In this way, in the color printer 100 and the color copying machine 102 using only the normal toners of yellow (V), cyan (C), magenta (M), and black (BK), it becomes also possible to form an image with the special foamable toner E simply by replacing developing devices.

Figure 5:
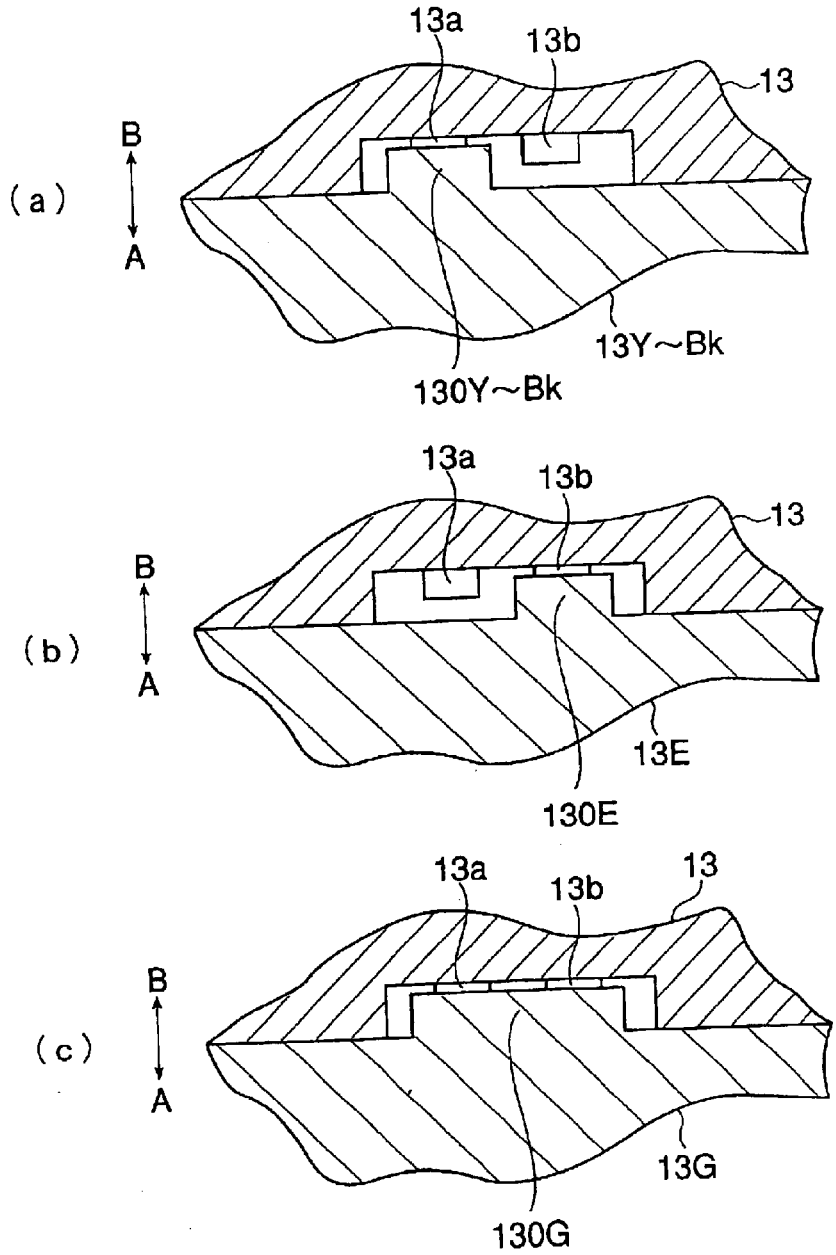
FIGS. 5A to 5C are sectional views illustrating a projected portion and buttons of the developing device of the rotary developing apparatus of FIGS. 3A and 3B.

In addition, as shown in FIGS. 5A to 5C, in a developing apparatus 13, a first button (developing unit judging section) 13*a* and a second button (developing unit judging section) 13*b* are provided. In each of the developing devices 13Y to 13BK[13(1) to 13(4)], a projected portion (special shape) 130Y-BK of a shape corresponding to characteristics of a developer contained in the developing device 13(1) to 13(4) is provided. The developing apparatus 13 is constituted such that, when each of the developing devices 13(1) to 13(4) is mounted on the developing apparatus 13, these first and second buttons 13*a* and 13*b* and the projected portion 130Y-BK are opposed to each other.

Here, in each of the developing devices 13Y to 13BK corresponding to the toners of yellow (Y), cyan (C), magenta (M), and black (BK), first projected portions 130Y to 130BK are formed as shown in FIG. 5A. When the developing devices 13Y and 13BK are mounted on the developing apparatus 13, only the first button 13*a* is pressed. In addition, in the developing device 13E corresponding to the foamable toner E, a second projected portion 130E as shown in FIG. 5B is formed. When the developing device 13E is mounted on the developing apparatus main body 13, only the second button 13*b* is pressed. Note that, in a developing device 13G corresponding to a gold toner G in Embodiment Mode 2 discussed later, a third projected portion 130G as shown in FIG. 5C is formed. When the developing device 13G is mounted on the developing apparatus 13, both the first button 13*a* and the second button 13*b* are pressed. Note that, although the developing devices of three types (the developing devices 13Y to 13BK, the developing device 13E, and the developing device 13G) are explained as being distinguished for simplicity, the developing devices 13Y to 13BK can be distinguished, respectively, by increasing the number of combinations of buttons and projected portions.

Moreover, when a developing device of the color printer 100 and the color copying machine 102 according to Embodiment Mode 1 is replaced, update of <1> an order of image formation, <2> image processing parameters, and <3> electrophotographic process parameters is automatically controlled according to characteristics of a toner contained in the replaced developing device. In this way, the image forming apparatus according to Embodiment Mode 1 makes it possible not only to form an image with the special foamable toner E by replacing a developing device but also to form an appropriate image according to characteristics of the foamable toner E.

Figure 6:
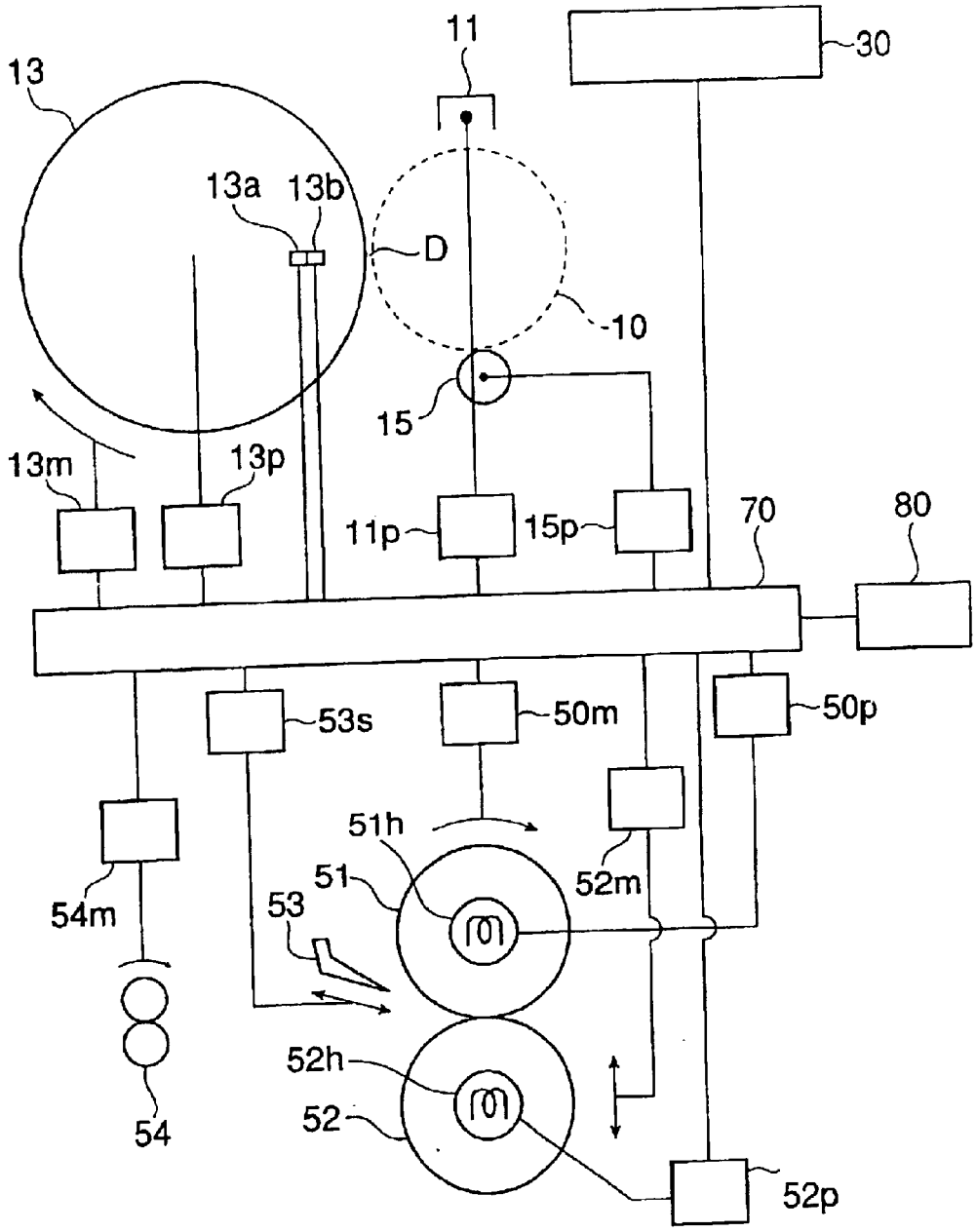
FIG. 6 is a block diagram illustrating a structure of a control system of the color printer and the color copying machine according to Embodiment Modes 1 to 3 of the present invention.

FIG. 6 is a functional block diagram illustrating a structure of this update control system. This control system is constituted with a control unit 70 as a main part. Signals inputted in the control unit 70 are <1> ON/OFF signals from the first button 13*a* and the second button 13*b*, <2> an instruction signal from a user interface device (user interface section) 80 including a touch panel or an operation button of the color printer 100 or a color copying machine 102, <3> gradation data from the image processing device (developing unit judging section) 30, and the like. Signals outputted to the control unit 70 are <1> a drive command given to a developing motor 13*m* for rotating the developing apparatus 13 of the rotary system, <2> an image processing update command for updating image processing parameters in the image processing device 30, and <3> a process update command for updating electrophotographic process parameters in each functional component of an image forming apparatus.

Moreover, this <3> process update command includes a charging bias update command given to a charging power supply section lip for applying a charging bias to the scorotron 11, a developing bias update command given to a developing power supply section 13*p* for applying a developing bias to each of the developing devices 13(1) to 13(4) of the developing apparatus 13, a primary bias update command given to a primary transfer power supply section 15*p* for applying a primary transfer bias to the primary transfer roll 15, a drive command given to a fixing motor 50*m* for rotating the heating roll 51 and the pressure roll 52, a heating power update command given to a heating power supply section 50*p* for applying an electric power to a halogen lamp (heating source) 51*h* of the heating roll (toner side fixing rotator) 51, a pressurizing power update command given to a pressurizing power supply section 52*p* for applying an electric power to a halogen lamp (heating source) 52*h* of the pressure roll (non-toner side fixing rotator) 52, a drive command given to a latch motor (latch section) 52*m* for bringing the pressure roll 52 into press-contact with the heating roll 51, a drive command given to a peeling pawl solenoid 53*s* for moving a position of a peeling pawl (peeling member) 53, and a drive command given to a conveyor motor 54*m* for rotating a conveyor roll 54 for conveying the recording paper P after fixing. The control unit 70 can control a charging potential, a developing bias, a primary transfer bias, and fixing conditions of the toner on the photosensitive drum 10 according to these process update commands, respectively.

Note that, as a specific structure of the control unit 70, the control unit 70 is provided with a hardware configuration including a central processing unit, a control device, a memory device, an input/output device, a bus connecting these devices to each other, and the like, and a software configuration including a control program and the like stored in the memory device in advance. Functions of the control unit 70 are realized by the hardware configuration and the software configuration.

Figure 7:
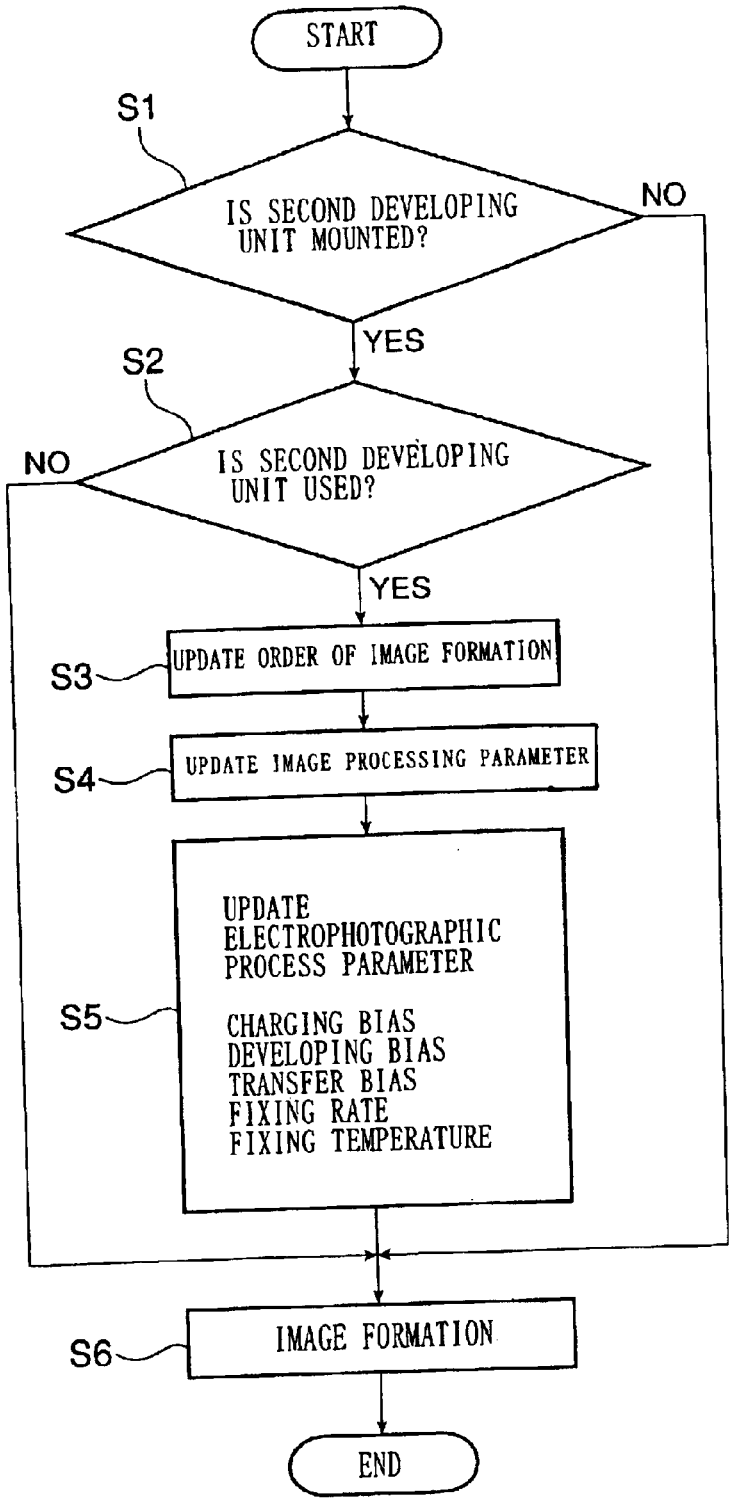
FIG. 7 is a flow chart explaining operations of the control system of the color printer and the color copying machine according to Embodiment Modes 1 to 3 of the present invention.

FIG. 7 is a flow chart explaining operations of this update control system. Update control operations of the color printer 100 and the color copying machine 102 according to Embodiment Mode 1 will be hereinafter described in accordance with this flow chart.

Embodiment 1

In explaining the update control operations of the color printer 100 and the color copying machine 102 according to Embodiment Mode 1, as an example (Embodiment 1) thereof, a case will be described in which the image forming apparatus is mounted with the developing device 13BK corresponding to the black toner BK as the first developing device 13(1), the developing device 13Y corresponding to the yellow toner Y as the second developing device 13(2), the developing device 13M corresponding to the magenta toner M as the third developing device 13(3), and the developing device 13C corresponding to the cyan toner C as the fourth developing device 13(4) as shown in FIG. 3A in an initial state of development and, thereafter, the first developing device 13(1) is changed from the developing device 13BK corresponding to the black toner BK to the developing device 13E corresponding to the foamable toner E as shown in FIG. 3B.

Figure 8:
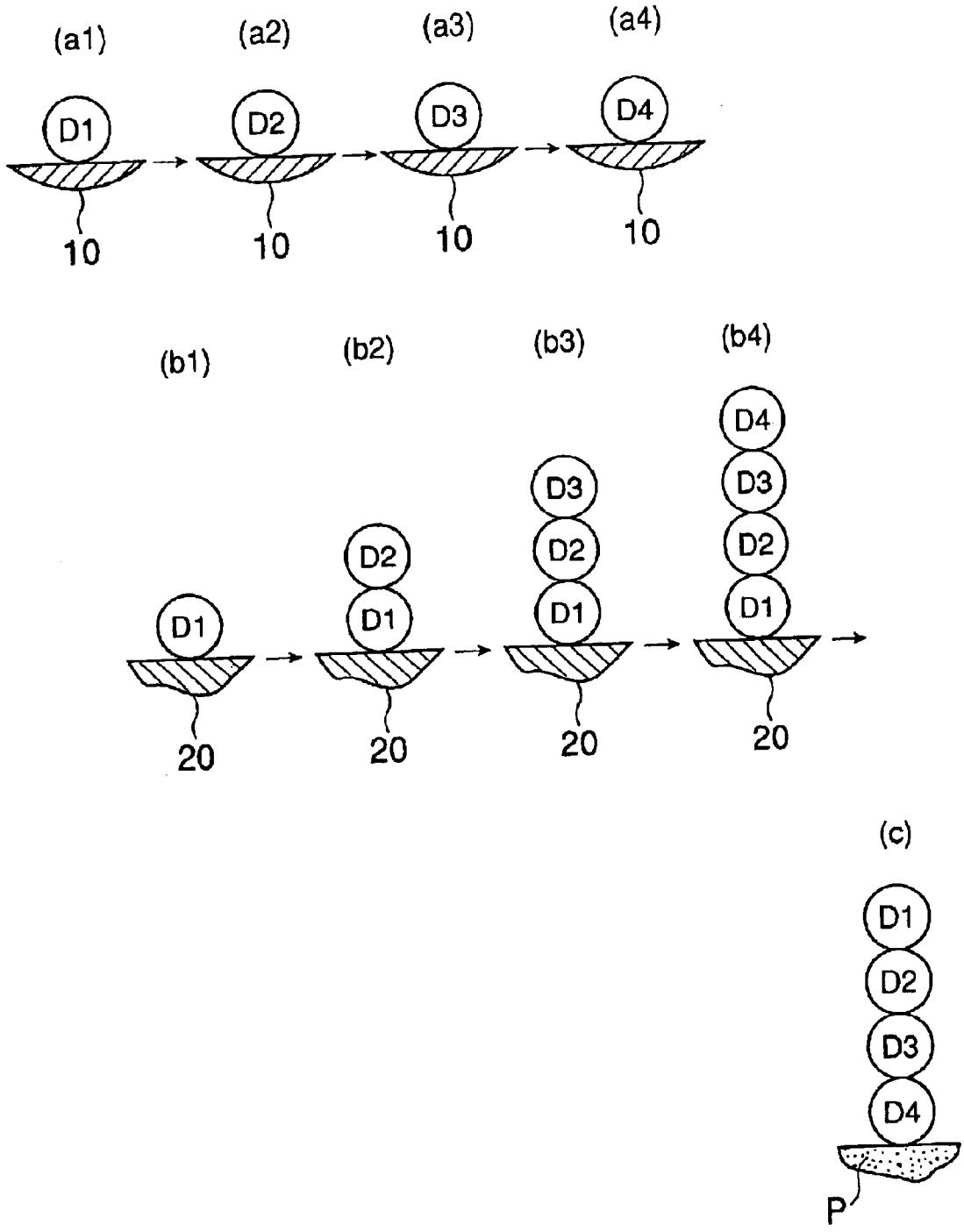

FIGS. 8A1 to 8A4, 8B1 to 8B4, and 8C illustrate steps of forming and stacking toner images in the color printer 100 and the color copying machine 102 according to Embodiment Mode 1. FIGS. 8A1 to 8A4 illustrate steps of forming toner images D1 to D4 on the photosensitive drum 10. FIGS. 8B1 to 8B4 illustrate steps of forming and stacking the toner images D1 to D4 on the intermediate transfer belt 20. FIG. 8C illustrates a step of stacking the toner images D1 to D4 on the recording paper P.

In this embodiment, the toner image (D1) formed of the black toner BK, the toner image (D2) formed of the yellow toner Y, the toner image (D3) formed of the magenta toner M, and the toner image (D4) formed of the cyan toner C are developed on the photosensitive drum 10 sequentially in the developing area D, respectively, in the initial state (see FIGS. 1 and 2). These toner images are primarily transferred onto the intermediate transfer belt 20 sequentially in the primary transfer position T1. Finally, the toner image (D1) formed of the black toner BK, the toner image (D2) formed of the yellow toner Y, the toner image (D3) formed of the magenta toner M, and the toner image (D4) formed of the cyan toner C are stacked from a bottom layer to a top layer on the intermediate transfer belt 20. The stacked toner images are secondarily transferred onto the recording paper P in the secondary transfer position T2 at one time. As a result, the toner image (D4) formed of the cyan toner C, the toner image (D3) formed of the magenta toner M, the toner image (D2) formed of the yellow toner Y, and the toner image (D1) formed of the black toner BK are stacked from a bottom layer to a top layer on the recording paper P.

Next, after changing the first developing device 13(1) from the developing device 13BK to the developing device 13E, when an image is formed, the update control operation shown in the flow chart of FIG. 7 is performed.

First, the control unit 70 judges whether or not the developing device (second developing unit) 13E is mounted on the developing apparatus 13 (S1 in FIG. 7). That is, in the case where the first button 13*a* is "OFF" and the second button 13*b* is "ON", when the developing device 13E is mounted, the control unit 70 judges that the developing device 13E is mounted (see FIG. 5B). Note that, other than this operation, a type of a developing device can also be judged by providing a sensor or utilizing an electric resistance value, a voltage difference, or the like.

In the case where the developing device 13E is mounted, the control unit 70 judges whether or not the developing device (second developing unit) 13E is used (S2 in FIG. 7). In the case of the color printer 100, the image processing device (image processing section) 30 judges whether or not a three-dimensional image forming command is included in an image forming command from a personal computer or the like connected to the color printer 100, and the control unit 70 makes the above judgment based on the judgment of the image processing device 30. In the case of the color copying machine 102, the control unit 70 makes the above judgment based on whether or not a three-dimensional image forming command has been inputted directly from a user via the user interface device (user interface section) 80.

If the developing device 13E is used, the control unit 70 updates an order of image formation of the image forming apparatus (S3 in FIG. 7). That is, the control unit 70 sends a drive command to the developing motor 13*m*, thereby updating the order of image formation as follows: before replacing a developing device, the control unit 70 moves the developing device 13(1) to 13(4) to the developing area D opposed to the photosensitive drum 10 in the order of the first developing device 13(1)(=13BK), the second developing device 13(2)(=13Y), the third developing device 13(3) (=13M), and the fourth developing device 13(4)(=13C) to develop images by the developing device 13(1) to 13(4), whereas, after replacing the developing device, the control unit 70 moves the developing device 13(1) to 13(4) to the developing area D opposed to the photosensitive drum 10 in the order of the second developing device 13(2)(=13Y), the third developing device 13(3)(=13M), the fourth developing device 13(4)(=13C), and the first developing device 13(1) (=13E) to develop images by the developing device 13(1) to 13(4).

By updating an order of image formation as described above, after replacing a developing device, the toner image (D1) formed of the yellow toner Y, the toner image (D2) formed of the magenta toner M, the toner image (D3) formed of the cyan toner C, and the toner image (D4) formed of the foamable toner E are developed on the photosensitive drum 10 sequentially in the developing area D, respectively, in the initial state (see FIGS. 1 and 2). These toner images are primarily transferred onto the intermediate transfer belt 20 sequentially in the primary transfer position T1. Finally, the toner image (D1) formed of the yellow toner Y, the toner image (D2) formed of the magenta toner M, the toner image (D3) formed of the cyan toner C, and the toner image (D4) formed of the foamable toner E are stacked from a bottom layer to a top layer on the intermediate transfer belt 20. The stacked toner images are secondarily transferred onto the recording paper P in the secondary transfer position T2 at one time. As a result, the toner image (D4) formed of the foamable toner E, the toner image (D3) formed of the cyan toner C, the toner image (D2) formed of the magenta toner M, and the toner image (D1) formed of the yellow toner Y, are stacked from a bottom layer to a top layer on the recording paper P. That is, the toner image (D4) formed of the foamable toner E always constitutes the lowermost layer.

In addition, in the case where the developing device 13E is used, the control unit 70 updates image processing parameters of the image forming apparatus (S4 in FIG. 7). That is, the control unit 70 sends an image processing update command to the image processing device 30, thereby first changing a type of gradation data, and secondly performing image processing such that a toner image formed of the other toners Y to C is not formed in the outline part (over a very small width) of the toner image with the foamable toner E.

Here, a type of gradation data is changed for the purpose of performing image processing such that: gradation data of so-called process black is obtained in which gradation data of yellow (Y), magenta (M), and cyan (C) is used instead of obtaining gradation data of single black (BK) and performing image processing, whereas, before replacing the developing device, gradation data of four colors of yellow (Y), magenta (M), cyan (C), and black (BK) (8 bits each) is obtained from reflectance data of the original d; and gradation data is newly generated for a three-dimensional image.

In addition, image processing as described below is performed in order not to form a toner image formed of the other toners Y to C in the outline part of the toner image formed of the foamable toner E, or in order to form a toner image formed of the other toners Y to C only on the upper surface of the toner image formed of the foamable toner E and in order not to form a toner image formed of the other toner Y to C on the side (slant surface) of the image with the foamable toner E.

Figure 9:
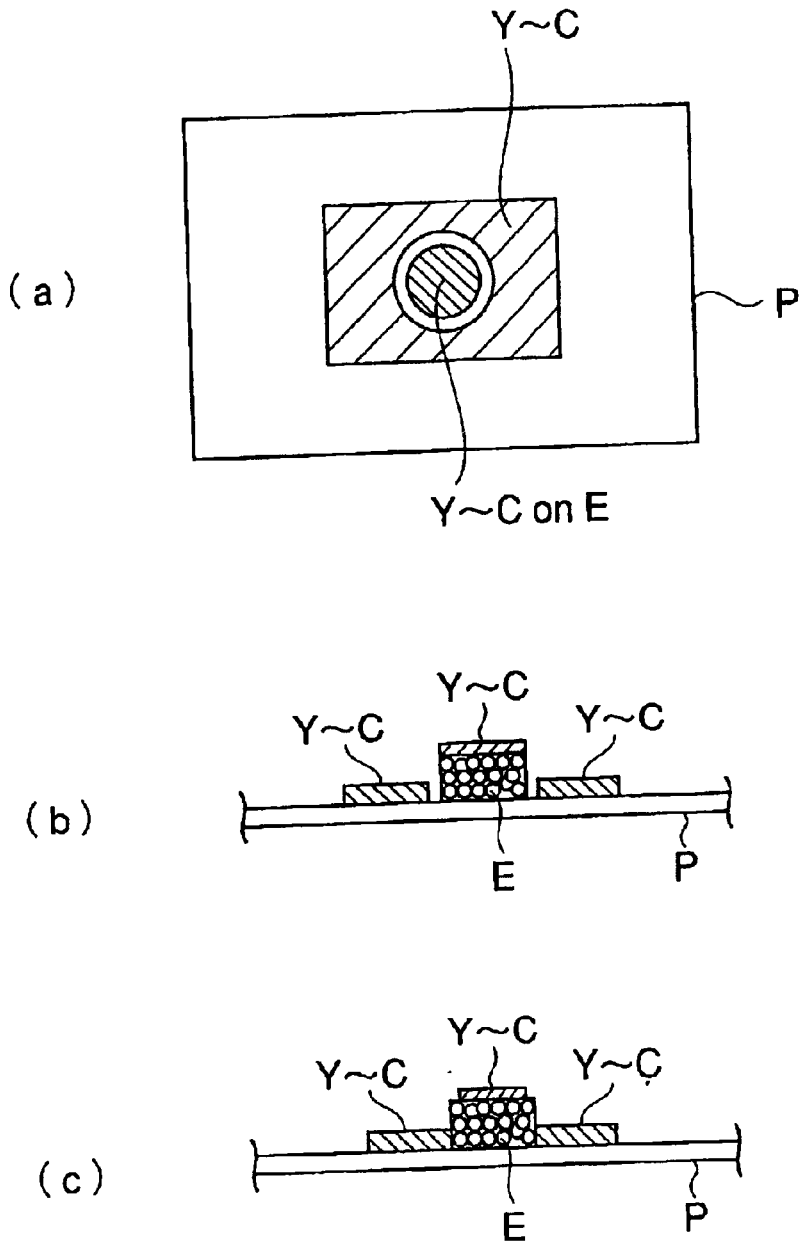
FIGS. 9A to 9C illustrate image processing control of the color printer according to Embodiment Modes 1 to 5 of the present invention.

A toner image formed of the toners Y, M, and C, and the foamable toner E, which is secondarily transferred onto the recording paper P, is not formed in the same manner as a normal full-color image. Image processing is performed such that a toner image formed of the toners Y, M, and C is not formed over a predetermined very small width (about several $\mu$m to 40 $\mu$m) in an outline part of a three-dimensional image, which is formed with the foamable toner E subsequent to forming the toner image formed of the toners Y, M, and C, as shown in FIG. 9A. More specifically, the image processing is adapted such that an edge part of a three-dimensional image is detected by an edge detection circuit of the image processing device 30 and gradation data of Y, M, and C is not generated over a predetermined very small width in the edge part of the three-dimensional image. In this case, in the edge part of three-dimensional image, a gap may be set over a predetermined very small width in the external periphery of the three-dimensional image as shown in FIG. 9B. Alternatively, a gap may be set over a predetermined very small width in the internal periphery of the three-dimensional image as shown in FIG. 9C.

By performing such image processing, a gap with a very small width is formed in the outline part of the three-dimensional image formed of the foamable toner E. Thus, even if a supporting body such as the recording paper P is bent, an unbearable tension or compressive force does not act on the toner image formed of the toners Y, M, and C formed in the outline part of the three-dimensional image, the toner image formed of the toner Y, M, and C is not destroyed. Therefore, it becomes possible to form a three-dimensional full-color image having sufficient durability at low costs.

In addition, in the case where the developing device 13E is used, the control unit 70 updates electrophotographic process parameters of the image forming apparatus (S5 in FIG. 7). That is, the control unit 70 sends a charging bias update command, a developing bias update command, a primary transfer bias update command, a drive command, and a heating power update command to the charging power supply section 11*p*, the developing power supply section 13*p*, the primary transfer power supply section 15*p*, the fixing motor 50*m*, and the heating power supply section 50*p*, respectively.

Consequently, the control unit 70 can control a charging potential and a developing bias on the photosensitive drum 10 at the time when the developing device 13E develops an image, a primary transfer bias at the time when a toner image formed of the foaming toner E is primarily transferred, and fixing conditions at the time when the toner image formed of the foaming toner E is fixed.

TABLE 1

| Fixing conditions | First | Intermediate | Second |
|---|---|---|---|
| Fixing rate: VF | VF(1) | VF(m) | VF(2) |
| Heating roll temperature (surface temperature): TS | TS(1) | TS(m) | TS(2) |
| Pressure roll temperature: TN | TN(1) | TN(m) | TN(2) |
| Latch timing: L | L(1) | L(m) | L(2) |
| Peeling member position: P | P(1) | P(m) | P(2) |
| Conveying speeds after fixing | VA(1) | VA(m) | VA(2) |

Figure 10:
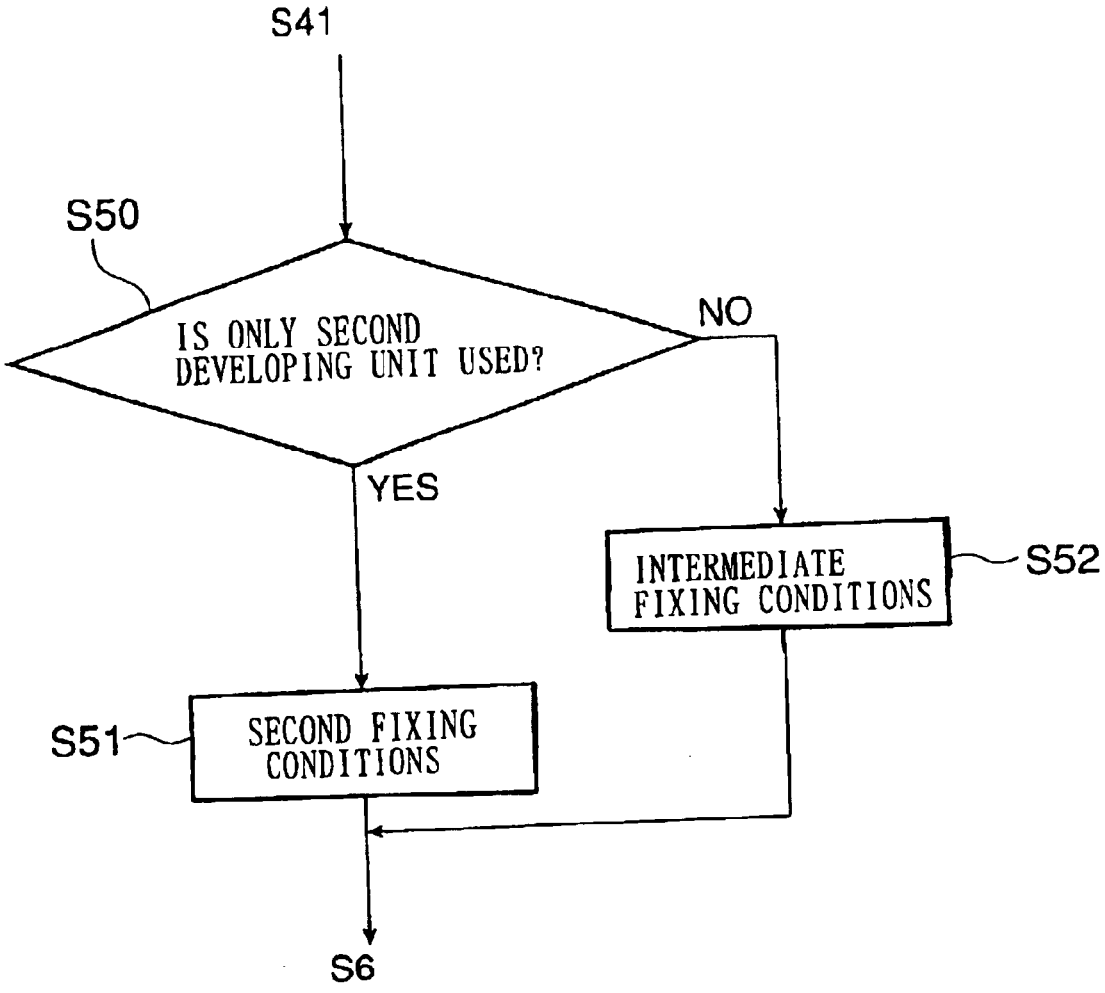
FIG. 10 is a flow chart explaining an operation for determining fixing conditions.

FIG. 10 is a flow chart of an operation performed by the control unit 70 in determining fixing conditions at the time when the toner image formed of the foaming toner E is fixed. Table 1 is a table in which fixing conditions of the color printer 100 and the color copying machine 102 according to this embodiment are arranged.

The control unit 70 judges whether or not only the developing device 13E (second developing unit) is used (S50 in FIG. 10). The control unit 70 can make this judgment according to whether or not gradation data obtained from the image processing device 30 is only gradation data corresponding to the foaming toner E.

In the case where only the developing device 13E is used, the second fixing conditions are selected as the fixing conditions (S51). In addition, in the case where both the developing device E and the other developing devices Y to C are used, the intermediate fixing conditions are selected (S52). Moreover, even if both the developing device E and the other developing devices Y to C are used, conditions closer to the second fixing conditions are selected as the intermediate fixing conditions in the case where the developing device E is used more frequently, and conditions closer to the first fixing conditions are selected as the intermediate conditions in the case where the other developing devices Y to C are used more frequently. Here, the control unit 70 can judge which of the developing device E and the developing devices Y to C is used and how frequently it is used based on gradation data corresponding to the developing devices obtained from the image processing device 30. Note that, in the case where the developing device 13E corresponding to the foaming toner E is not used at all (see S1 and S2 in FIG. 7), the first fixing conditions are selected as the fixing conditions.

First, concerning a fixing rate VF, for example, VF(1) is set to approximately 140 to 250 mm/sec and VF(2) is set to a value that is lower than that of VF(1), for example, 10 to 130 mm/sec. This is because, in general, it is necessary to give the foaming toner E a larger amount of heat compared with a normal color toner. Note that the fixing rate VF is updated until the recording paper P is conveyed to a nip portion of the fixing apparatus 50.

Second, concerning a heating roll temperature TS, for example, TS(1) is set to approximately 130 to 190° C. and TS(2) is set to a value that is five or more degrees higher than that of TS(1). This is because, in general, it is necessary to give the foaming toner E a larger amount of heat compared with a normal color toner. Note that the heating roll temperature TS is preferably updated until the recording paper P is conveyed to a nip portion of the fixing apparatus 50.

Note that, in relation to the heating roll temperature TS described above, concerning a pressure roll temperature TN, for example, TN(1) is set to approximately 80 to 180° C. and TN(2) is set to a value that is five or more degrees higher than that of TN(1). This is because, in general, it is necessary to give the foaming toner E a larger amount of heat compared with a normal color toner. In particular, since the foaming toner E is formed on the lowermost layer, that is, on the pressure roll side as already described (see S2 in FIG. 7, and FIG. 8C), it is preferable to increase a pressure roll temperature because a necessary amount of heat can be given to the foaming toner E without increasing the fixing temperature, that is, the heating roll temperature TS too much. Note that the heating roll temperature TN is preferably high updated until the recording paper P is conveyed to a nip portion of the fixing apparatus 50.

Third, concerning latch timing L, L(1) is set to certain timing until the recording paper P reaches the fixing apparatus 50 after the color printer 100 and the color copying machines 102 are driven, and L(2) is set to timing that is approximately 1 to 10 seconds earlier than that of L(1) In this way, the heating roll 51 and the pressure roll 52 are brought into press-contact with each other earlier, whereby the temperature TN of the pressure roll 52 can be increased earlier, and a necessary amount of heat can be given to the foaming toner E. Note that, in the case where the certain timing from the start-up of the apparatus until the recording paper P reaches the fixing apparatus 50 is short, it is preferable to delay conveyance timing of the recording paper P.

Fourth, concerning a peeling member position P, as P(1), the tip of the peeling pawl 53 is placed in a position approximately 1 to 8 mm from a press-contact portion of the heating roll 51 and the pressure roll 52, and as P(2), the tip of the peeling pawl 53 is placed in a position approximately 4 to 14 mm from the press-contact portion, which is set apart from the press-contact portion by a larger distance than P(1). This is for preventing the three-dimensional image from being damaged by the peeling pawl 53 because an image is formed three-dimensionally and the three-dimensional image has not become solid yet. Note that the peeling member position P is updated by the time when the recording paper P is conveyed to the nip portion of the fixing apparatus 50.

Fifth, concerning a conveying speed after fixing VA, VA(1) is set to, for example, a speed increased by approximately 10 to 100% from VF(1), and VA(2) is set to a speed lower than VA(1) but increased by approximately 0 to 50% from VF(2). Usually, a conveying speed after fixing is set relatively higher than a fixing rate taking into account sheet dischargeability. This is for, in the case where a three-dimensional image formed of the foaming toner E is formed, preventing the three-dimensional image from being damaged due to a large change in the speed after fixing. Note that the conveying speed after fixing VA is updated by the time when the recording paper P is conveyed to the nip portion of the fixing apparatus 50.

Note that these are controlled by a drive command given to the fixing motor 50*m*, a heating power update command given to the heating power supply section 50*p*, a heating power supply update command given to the pressurizing power supply section 52*p*, a drive command given to the latch motor (latch section) 52*m*, a drive command given to the peeling pawl solenoid 53*s*, and a drive command given to the conveyor motor 54*m*, which are sent by the control unit 70.

Then, after automatically updating and determining the order of image formation, the image processing parameters, and the electrophotographic process parameters, the control unit 70 performs image formation (S6 in FIG. 7). Here, a height of the unfixed toner image formed of the foamable toner E was 55 to 60 $\mu$m. Thereafter, the toner image is subjected to fixing processing under heat and pressure by the heating roll 51 and the pressureroll 52 of the fixing apparatus 50, and a binder resin in the foamable toner E melts and, at the same time, a foaming agent in the foaming toner E foams, whereby the three-dimensional image and the full-color image formed of the toners Y, M, and C are fixed on the recording paper P. The three-dimensional image fixed on the recording paper P expanded to 130 $\mu$m in height.

Note that, although an order of development is automatically determined according to a type of a mounted developing device in Embodiment 1, the image forming apparatus can be constituted such that a user can determine the order of development personally via the user interface device 80.

Note that, although the case where the developing device 13BK corresponding to the black toner BK forming the uppermost layer (see D1 in FIG. 8) on the recording paper P is replaced with the developing device 13E corresponding to the foamable toner E, which should form the lowermost layer (see D4 in FIG. 8) on the recording paper P, is described in Embodiment 1, other examples are shown in Embodiments 2 to 6 in Tables 2 and 3.

TABLE 2

| | D1 | D2 | D3 | D4 |
|---|---|---|---|---|
| Embodiment 1 | BK | Y | M | C |
| Embodiment 2 | BK | Y | C | M |
| Embodiment 3 | BK | M | Y | C |
| Embodiment 4 | BK | M | C | Y |
| Embodiment 5 | BK | C | Y | M |
| Embodiment 6 | BK | C | M | Y |

TABLE 3

| | D1 | D2 | D3 | D4 |
|---|---|---|---|---|
| Embodiment 1 | Y | M | C | E |
| Embodiment 2 | Y | C | M | E |
| Embodiment 3 | M | Y | C | E |
| Embodiment 4 | M | C | Y | E |
| Embodiment 5 | C | Y | M | E |
| Embodiment 6 | C | M | Y | E |

Table 2 shows combinations of the toner images D1 to D4 before replacing a developing device. Table 3 shows combinations of the toner images D1 to D4 after replacing the developing device. Moreover, the developing device 13 corresponding to the toner forming the layers other than the uppermost layer (see D2, D3, and D4 in FIG. 8) on the recording paper P can also be replaced with the developing device 13E corresponding to the foamable toner E that should constitute the lowermost layer (see D4 in FIG. 8) on the recording paper P.

Note that, in all Embodiments 1 to 6, the developing device 13BK corresponding to the black toner BK is replaced with the developing device 13E corresponding to the foamable toner E. However, any one of the other developing devices 13Y, 13M, and 13C can also be replaced with the developing device 13E. In addition, although the image forming apparatus according to Embodiments 1 to 6 is not provided with the developing device E in an initial state of development, it may be provided with the developing device E from the initial state. In this case, the step of S1 in FIG. 7 is not performed.

Foaming Toner

The foaming toner E used in Embodiments 1 to 5 will be hereinafter described in detail. The foamable toner E is a toner for image formation containing at least a binder resin and a foaming agent, and a toner in which a foaming agent is not substantially exposed to the surface of the toner is used as the foamable toner E.

Any foaming agent can be used without particular limitation as long as it expands in volume with heat. It may be solid or liquid under normal temperature. In addition, a material of the foaming agent is not limited to a material including a single substance but may be a material including plural substances or a functional material such as micro-capsule particles. A preferable range of a foaming temperature of the foaming agent differs depending upon what kind of apparatus is used to form a three-dimensional image. In the case where a three-dimensional image is formed using the ordinary printer or copying machine as shown in FIG. 1 or 2, the foaming temperature is preferably equal to or lower than a heating and fixing temperature.

As the foaming agent, for example, a foaming agent containing a substance generating gas due to thermal decomposition as a main material can be used. More specifically, examples of the foaming agent include bicarbonate such as sodium bicarbonate generating carbon dioxide, a mixture of $NaNo_2$ and $NH_4Cl$ generating nitrogen gas, azo compounds such as azobisisobutyronitrile and diazoaminobenzene, and peroxide generating oxide and the like.

Other forms of the foaming agent include a foaming agent of micro-capsule particles encapsulating a low boiling point substance that vaporizes at a low temperature (which may be in a liquid state or a solid state under normal temperature) (hereinafter referred to as "micro-capsule type foaming agent" in some cases). The micro-capsule type foaming agent is preferable because it is highly foamable. In the case where the toner for image formation of this embodiment mode is used in the ordinary printer, copying machine, or the like, the low boiling point substance contained in the micro-capsule is required to at least vaporize at a temperature lower than the heating and fixing temperature. More specifically, it is a substance that vaporizes at 100° C. or less, preferably 50° C. or less, and more preferably 25° C. or less. However, since thermal responsiveness of the micro-capsule type foaming agent depends not only on a boiling point of the low boiling point substance, which serves as a core material, but also on a softening point of a wall material, a preferable boiling point range of the low boiling point material is not limited to the aforementioned range. Examples of the low boiling point substance include neopentane, neohexane, isopentane, isobutylene, and isobutane. Among them, isobutane is preferable which is stable with respect to the wall material of the micro-capsule and has a high thermal expansion coefficient.

As the wall material of the micro-capsule, a material is preferable which has solvent resistance against various solvents used in a manufacturing process of a toner and has non-permeability against gas when the low boiling point substance encapsulated in the micro-capsule vaporizes. In addition, in the case where the toner for image formation of this embodiment mode is used for the ordinary printer, copying machine, or the like, the wall material is required to soften and expand at a temperature lower than the heating and fixing temperature. As the wall material of the micro-capsule, a wall material that has been used conventionally can be used extensively. For example, a homopolymer such as polyvinyl chloride, polyvinyl acetate, polystyrene, polyacrylonitrile, polybutadiene, and polyacrylic acid ester, and copolymers of these are preferably used. Among them, a copolymer of vinylidene chloride and acryronitrile is preferable in that it has a high adhesive property with a binder resin and has a high solvent resistance against solvents.

A preferable range of a content of the foaming agent in the toner of this embodiment mode varies depending upon a type of the foaming agent. Usually, it is 5 to 50 wt %, and preferably 10 to 40 wt %. When the content of the foaming agent is 5 wt % or less, thermal expansion of the toner may become insufficient practically. On the other hand, when the content of the foaming agent exceeds 50 wt %, a percentage of the binder resin in the toner may become insufficient relatively to cause a problem such as failure to obtain a sufficient fixing property.

The binder resin of the toner for three-dimensional image formation of this embodiment is not specifically limited, and any resin that is generally used as a resin for toner can be used. More specifically, a polyester resin, a styrene resin, an acrylic resin, a styrene-acrylic resin, a silicone resin, an epoxy resin, a diene resin, a phenol resin, an ethylene-vinyl acetate resin, and the like can be used. Among them, the polyester resin is more preferable.

Two or more kinds of the polyester resin may be combined and other resins may be further combined with the binder resin of this embodiment mode. As other resins, there are a styrene resin, an acrylic resin, a styrene-acrylic resin, a silicone resin, an epoxy resin, a diene resin, a phenol resin, a terpene resin, a coumarin resin, an amide resin, an amide-imide resin, a butyral resin, a urethane resin, an ethylene-vinyl acetate resin, a polypropylene resin, a polyethylene resin, and a natural wax resin such as Carnauba wax. In this embodiment mode, it is preferable to use the polyester resin as a main component and add the other resins in an amount of 0 to 30 wt %. In addition, in the case where a foaming agent is dispersed in a monomer of the binder resin to produce a toner by suspending and polymerizing these, a monomer, which can be suspended and polymerized, in the binder resin can be used.

When a toner particle of the foamable toner E is sliced and the slice is observed with a microscope, it is found that the toner consists at least of the binder resin and a foaming agent particle, and the foaming agent particle is contained on the core portion side of the toner without losing a foaming property. Since the toner particle of the foamable toner E has a structure in which the foaming agent is not substantially exposed to its surface, the toner has a high thermal expansion property and, at the same time, favorably maintains an adhesive property and a charging stability with respect to a recording medium.

Note that "not substantially exposed to its surface" in this context indicates that, for example, as a result of observing electron micrographs of fifty toner particles, it is found that there are 80% or more toners in which the foaming agent is not exposed to the surface thereof at all. In addition, it is preferable that the foaming agent is dispersed as particles in the toner uniformly because the adhesive property and the charging stability of the toner with respect to the recording medium can be improved more.

A colorant is not contained in the foamable toner E of Embodiment Mode 1. However, a colorant may be contained to color and visualize the toner. As a colorant to be dispersed, a publicly known organic or inorganic pigment, dye, or oil-soluble dye can be used. In general, a percentage of approximately 1 to 100 parts by weight is appropriate for these colorants with respect to 100 parts by weight of toner, although it depends on a particle diameter of toner or an amount of development.

In addition, a magnetic substance may be contained in the foamable toner E in order to give magnetization to the toner. As a type of the magnetic substance, a publicly known one can be used appropriately. Moreover, a release agent may be contained in the foamable toner E if so desired. This is preferable because an offset phenomenon or the like at the time when the foam able toner E is brought into contact with a recording paper and fixed thereon can be prevented by containing the release agent in the toner. Note that a charging control agent may be added in the foamable toner E if so desired. Moreover, a publicly known externally added agent may be contained in the foamable toner E in order to control its flowability and developing property.

As a method of producing the foamable toner E, for example, the foamable toner foamable toner E is produced by a process including a step of suspending and dispersing an oil phase, in which at least a binder resin and a foaming agent are dissolved and/or dispersed in a solvent, in a water phase to produce particles including the oil phase and a step of removing the solvent from the particles. In addition, the foamable toner E may be produced by a process including a step of suspending and polymerizing a monomer for binder resin, in which at least a foaming agent is dissolved or dispersed, in a water phase. In the foamable toner E, a binder polymer was contained as a binder resin by 75 wt % and Expancel 461 by 25 wt %. A volume average particle diameter of this foamable toner E was approximately 30 $\mu$m.

In using the foamable toner E, a development system may be any of the two-component development system, the nonmagnetic one-component development system, and the magnetic one component development system. In this embodiment mode, the two-component development system is adopted to form an image. As a toner composition, a wax for realizing oil-less beat fixing may be contained or may not be contained both in a foamable toner and a non-foaming full-color toner. In this embodiment mode, toners in which the wax is not contained are adopted for both of a foaming toner and a non-foaming color toner, and an image is formed by a soft roll fixing apparatus equipped with an oil system.

What is claimed is:

1. An image forming apparatus comprising:

an image bearing member;

a first developing unit for forming an image consisting of one type or plural types of first developer which does not contain a foaming agent on the image bearing member;

a second developing unit for forming an image consisting of one type or plural types of second developer which contains a foaming agent on the image bearing member;

a transfer section for transferring the image formed on the image bearing member to a recording medium;

a fixing apparatus for fixing the image on the recording medium under predetermined fixing conditions and conveying the same;

a developing unit judging section for judging a type of a developing unit used by the image forming apparatus; and a control unit for controlling the fixing conditions based on a judgment result of the developing unit judging section.

2. An image forming apparatus according to claim 1, further comprising a user interface section in which an instruction from a user is inputted, wherein the developing unit judging section judges a type of a developing unit used by the image forming apparatus based on an instruction from the user interface section.

3. An image forming apparatus according to claim 1, further comprising an image processing section in which an image forming command is inputted, wherein the developing unit judging section judges a type of a developing unit used by the image forming apparatus based on a result of analysis of the image forming command by the image processing section.

4. An image forming apparatus according to claim 1, wherein the control unit controls fixing conditions such that first fixing conditions in using only the first developing unit and second fixing conditions in using only the second developing unit are different from each other.

5. An image forming apparatus according to claim 1, wherein the control unit controls the fixing conditions such that first fixing conditions in using only the first developing unit and second fixing conditions in using only the second developing unit are different from each other, and in the case where both the first developing unit and the second developing unit are used, the control unit controls the fixing conditions such that intermediate fixing conditions between the first fixing conditions and the second fixing conditions are realized.

6. An image forming apparatus according to claim 1, wherein the control unit controls fixing conditions such that first fixing conditions in using only the first developing unit and second fixing conditions in using only the second developing unit are different from each other, and in the case where both the first developing unit and the second developing unit are used, controls the fixing conditions such that intermediate fixing conditions between the first fixing conditions and the second fixing conditions are realized and, at the same time, determines the intermediate fixing conditions according to a frequency of using the first developing unit and the second developing unit.

7. An image forming apparatus according to claim 1, wherein a fixing section is provided with a pair of fixing rotators that come into press-contact with each other and rotate at a predetermining fixing rate, and the control unit controls fixing rates such that a second fixing rate as a second condition in using only the second developing unit is lower than a first fixing rate as a first fixing condition in using only the first developing unit.

8. An image forming apparatus according to claim 1, wherein a fixing section is provided with a pair of fixing rotators that come into press-contact with each other and rotate and a heating source that heats at least one of the pair of fixing rotators to a predetermined fixing temperature, and the control unit controls fixing temperatures such that a second fixing temperature as a second fixing condition in using only the second developing unit is higher than a first fixing temperature as a first fixing condition in using only the first developing unit.

9. An image forming apparatus according to claim 1, wherein a fixing section is provided with a pair of toner side and non-toner side fixing rotators that come into press-contact with each other and rotate and a heating source that heats the non-toner side fixing rotator to a predetermined fixing temperature, and the control unit controls fixing temperatures such that a second fixing temperature as a second fixing condition in using only the second developing unit is higher than a first fixing temperature as a first fixing condition in using only the first developing unit.

10. An image forming apparatus according to claim 1, wherein a fixing section is provided with a pair of fixing rotators that come into press-contact with each other and rotate, a heating source that heats at least one of the pair of fixing rotators, and a latch section that brings the pair of fixing rotators into press-contact with each other from a separated state at predetermined latch timing, and the control unit controls latch timing such that second latch timing as a second fixing condition in using only the second developing unit is earlier than first latch timing as a first fixing condition in using only the first developing unit.

11. An image forming apparatus according to claim 1, wherein a fixing section is provided with a pair of fixing rotators that come into press-contact with a portion of each other and rotate and a peeling member that is provided in a predetermined position on a downstream side of the press-contact portion and peels a recording medium adhering to the fixing rotators, and the control unit controls positions of the press-contact portion such that a second position as a second fixing condition in using only the second developing unit is apart from the press-contact portion by a larger distance than a first position as a first fixing condition in using only the first developing unit.

12. An image forming apparatus according to claim 1, wherein a fixing section is provided with a pair of fixing rotators that come into press-contact with a portion of each other and rotate and a conveyor member that conveys a recording medium after passing through the press-contact portion at a predetermined conveying speed, and the control unit controls conveying speeds after fixing such that a second conveying speed after fixing as a second fixing condition in using only the second developing unit is lower than a first conveying speed after fixing as a first fixing condition in using only the first developing unit.

13. An image forming apparatus comprising:

an image bearing member;

a first developing unit for forming an image consisting of one type or plural types of first developer which does not contain a foaming agent on the image bearing member;

a transfer section for transferring the image formed on the image bearing member to a recording medium;

a fixing apparatus for fixing the image on the recording medium under predetermined fixing conditions and conveying the same, the image forming apparatus being capable of having mounted thereto a second developing unit for forming an image consisting of one type or plural types of second developer which contains a foaming agent on the image bearing member;

a developing unit judging section for judging a type of a developing unit used by the image forming apparatus; and a control unit for controlling the fixing conditions based on a judgment result of the developing unit judging section.

14. An image forming apparatus according to claim 13, wherein the image forming apparatus is provided with only the first developing unit in an initial state and mounted with the second developing unit later.

15. An image forming apparatus according to claim 13, further comprising a user interface section in which an instruction from a user is inputted, wherein the developing unit judging section judges a type of a developing unit used by the image forming apparatus based on an instruction from the user interface section.

16. An image forming apparatus according to claim 13, further comprising an image processing section in which an image forming command is inputted, wherein the developing unit judging section judges a type of a developing unit used by the image forming apparatus based on a result of analysis of the image forming command by the image processing section.

17. An image forming apparatus according to claim 13, wherein the control unit controls fixing conditions such that first fixing conditions in using only the first developing unit and second fixing conditions in using only the second developing unit are different from each other.

18. An image forming apparatus according to claim 13, wherein the control unit controls the fixing conditions such that first fixing conditions in using only the first developing unit and second fixing conditions in using only the second developing unit are different from each other, and in the case where both the first developing unit and the second developing unit are used, the control unit controls the fixing conditions such that intermediate fixing conditions between the first fixing conditions and the second fixing conditions are realized.

19. An image forming apparatus according to claim 13, wherein the control unit controls fixing conditions such that first fixing conditions in using only the first developing unit and second fixing conditions in using only the second developing unit are different from each other, and in the case where both the first developing unit and the second developing unit are used, controls the fixing conditions such that intermediate fixing conditions between the first fixing conditions and the second fixing conditions are realized and, at the same time, determines the intermediate fixing conditions according to a frequency of using the first developing unit and the second developing unit.

20. An image forming apparatus according to claim 13, wherein a fixing section is provided with a pair of fixing rotators that come into press-contact with each other and rotate at a predetermining fixing rate, and the control unit controls fixing rates such that a second fixing rate as a second condition in using only the second developing unit is lower than a first fixing rate as a first fixing condition in using only the first developing unit.

21. An image forming apparatus according to claim 13, wherein a fixing section is provided with a pair of fixing rotators that come into press-contact with each other and rotate and a heating source that heats at least one of the pair of fixing rotators to a predetermined fixing temperature, and the control unit controls fixing temperatures such that a second fixing temperature as a second fixing condition in using only the second developing unit is higher than a first fixing temperature as a first fixing condition in using only the first developing unit.

22. An image forming apparatus according to claim 13, wherein a fixing section is provided with a pair of toner side and non-toner side fixing rotators that come into press-contact with each other and rotate and a heating source that heats the non-toner side fixing rotator to a predetermined fixing temperature, and the control unit controls fixing temperatures such that a second fixing temperature as a second fixing condition in using only the second developing unit is higher than a first fixing temperature as a first fixing condition in using only the first developing unit.

23. An image forming apparatus according to claim 13, wherein a fixing section is provided with a pair of fixing rotators that come into press-contact with each other and rotate, a heating source that heats at least one of the pair of fixing rotators, and a latch section that brings the pair of fixing rotators into press-contact with each other from a separated state at predetermined latch timing, and the control unit controls latch timing such that second latch timing as a second fixing condition in using only the second developing unit is earlier than first latch timing as a first fixing condition in using only the first developing unit.

24. An image forming apparatus according to claim 13, wherein a fixing section is provided with a pair of fixing rotators that come into press-contact with a portion of each other and rotate and a peeling member that is provided in a predetermined position on a downstream side of the press-contact portion and peels a recording medium adhering to the fixing rotators, and the control unit controls positions of the press-contact portion such that a second position as a second fixing condition in using only the second developing unit is apart from the press-contact portion by a larger distance than a first position as a first fixing condition in using only the first developing unit.

25. An image forming apparatus according to claim 13, wherein a fixing section is provided with a pair of fixing rotators that come into press-contact with a portion of each other and rotate and a conveyor member that conveys a recording medium after passing through the press-contact portion at a predetermined conveying speed, and the control unit controls conveying speeds after fixing such that a second conveying speed after fixing as a second fixing condition in using only the second developing unit is lower than a first conveying speed after fixing as a first fixing condition in using only the first developing unit.

26. An image forming apparatus comprising:

an image bearing member;

a first developing unit for forming an image consisting of one type or plural types of first developer on the image bearing member;

a second developing unit for forming an image consisting of one type or plural types of second developer different from the first developer on the image bearing member;

a transfer section for transferring the image formed on the image bearing member to a recording medium;

a fixing apparatus for fixing the image on the recording medium under predetermined fixing conditions and conveying the same;

a developing unit judging section for judging a type of a developing unit used by the image forming apparatus;

a control unit for controlling the fixing conditions based on the judgment result of the developing unit judging section; and a user interface section in which an instruction from a user is imputed, wherein the developing unit judging section judges the type of the developing unit used by the image forming apparatus based on an instruction from the user interface section.

27. An image forming apparatus comprising:

an image bearing member;

a first developing unit for forming an image consisting of one type or plural types of first developer on the image bearing member;

a second developing unit for forming an image consisting of one type or plural types of second developer different from the first developer on the image bearing member;

a transfer section for transferring the image formed on the image bearing member to a recording medium;

a fixing apparatus for fixing the image on the recording medium under predetermined fixing conditions and conveying the same;

a developing unit judging section for judging a type of a developing unit used by the image forming apparatus;

a control unit for controlling the fixing conditions based on the judgment result of the developing unit judging section; and an image processing section in which an image forming command is inputted, wherein the developing unit judging section judges the type of the developing unit used by the image forming apparatus based on a result of analysis of the image forming command by the image processing section.

28. An image forming apparatus comprising:

an image bearing member;

a first developing unit for forming an image consisting of one type or plural types of first developer on the image bearing member;

a second developing unit for forming an image consisting of one type or plural types of second developer different from the first developer on the image bearing member;

a transfer section for transferring the image formed on the image bearing member to a recording medium;

a fixing apparatus for fixing the image on the recording medium under predetermined fixing conditions and conveying the same;

a developing unit judging section for judging a type of a developing unit used by the image forming apparatus; and a control unit for controlling the fixing conditions based on the judgment result of the developing unit judging section, wherein the control unit controls the fixing conditions such that first fixing conditions in using only the first developing unit and second fixing conditions in using only the second developing unit are different from each other, and in the case where both the first developing unit and the second developing unit are used, the control unit controls the fixing conditions such that intermediate fixing conditions between the first fixing conditions and the second fixing conditions are realized.

* * * * *